United States Patent [19]

Heinrich et al.

[11] Patent Number: 4,621,231

[45] Date of Patent: Nov. 4, 1986

[54] TOROIDAL SENSOR COIL AND METHOD

[75] Inventors: Theodore M. Heinrich; Lawrence W. Frost, both of Murrysville, Pa.

[73] Assignee: Westinghouse Electric Corp., Pittsburgh, Pa.

[21] Appl. No.: 622,291

[22] Filed: Jun. 19, 1984

[51] Int. Cl.[4] ..... H01F 27/28; H01F 5/00

[52] U.S. Cl. ..... 324/142; 29/602 R; 324/127; 336/200; 336/225

[58] Field of Search ..... 324/142, 127; 336/200, 336/206, 208, 222, 223, 225; 29/602 R

[56] References Cited

U.S. PATENT DOCUMENTS 2,014,524 9/1935 Franz ..... 336/200
3,002,260 10/1961 Shortt et al. ..... 336/200 X

FOREIGN PATENT DOCUMENTS 1109521 1/1956 France ..... 336/225
1569235 5/1969 France ..... 336/225

*Primary Examiner*—Reinhard J. Eisenzopf
*Assistant Examiner*—Stephen M. Baker
*Attorney, Agent, or Firm*—L. P. Johns

[57] ABSTRACT

A sensor coil characterized by an elongated insulating substrate, which substrate is folded and formed into a cylindrical toroidal core having adjacent substrate sections disposed at acute angles to each other forming a star-like cross-section, a winding on at least one side of the substrate which winding includes transverse and longitudinal portions on each substrate section which transverse portions are parallel to the axis of a current conductor on which the coil is mounted.

12 Claims, 12 Drawing Figures

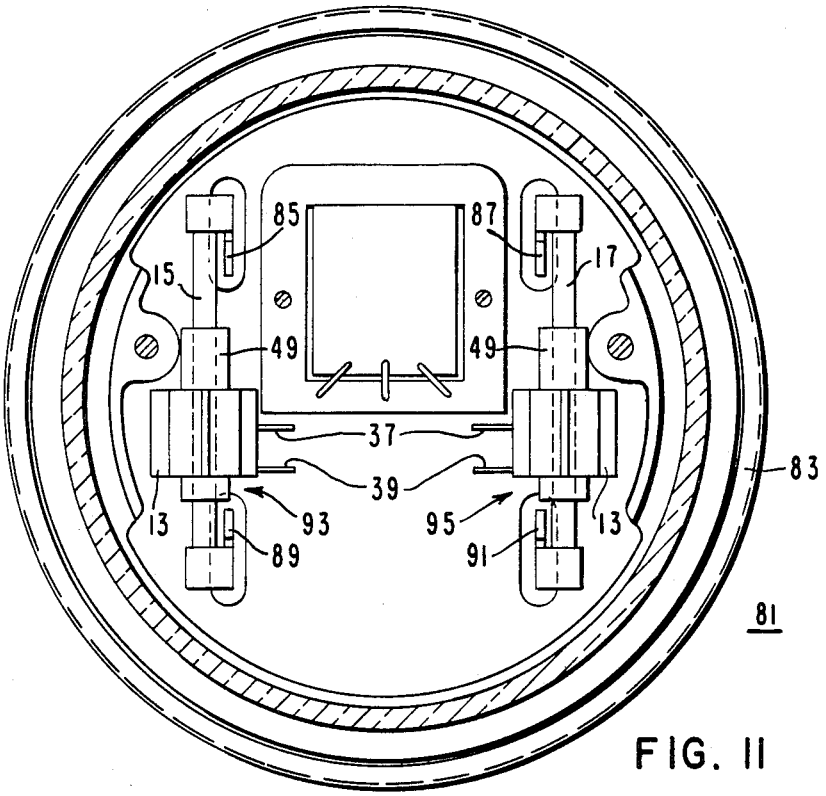
FIG. 11
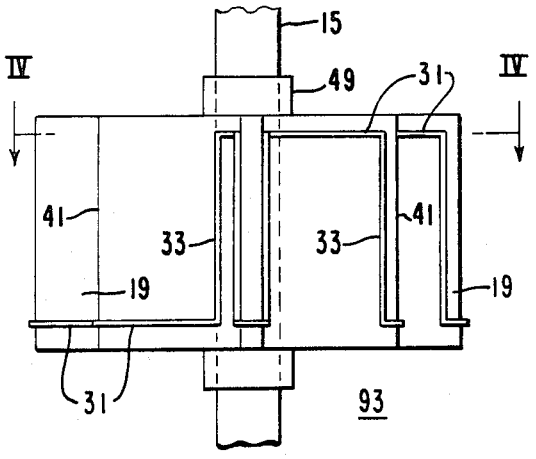
FIG. 12
FIG. 10
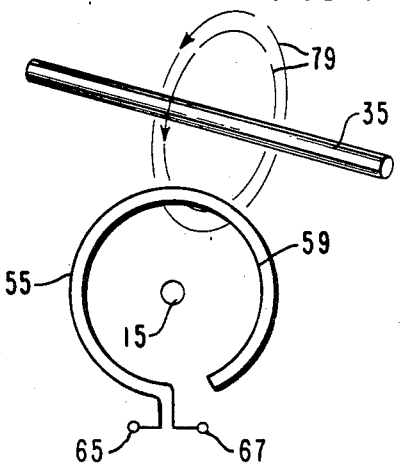

TOROIDAL SENSOR COIL AND METHOD

CROSS-REFERENCE TO RELATED APPLICATION

This application is related to Ser. No. 622,292, filed June 19, 1984 of T. H. York.

BACKGROUND OF THE INVENTION

1. Field of the Invention

This invention relates to an air core current transformer, and more particularly, it pertains to a toroidal winding of a dielectric substrate folded to form a cylindrical toroidal core.

2. Description of the Prior Art

Electronic watthour meters have been developed to replace the existing electromechanical meters to derive the advantages of greater accuracy, lower construction cost, and ease of interfacing with associated electronic equipment including time-of-day metering devices. Such devices are disclosed in U.S. Pat. No. 4,283,772, "Programmable Time Registering AC Electric Energy Meter Having Electronic Accumulator And Display".

A type of electronic watthour meter is disclosed in U.S. Pat. No. 4,413,230, for "Electric Energy Meter Having A Mutual Inductance Current Transducer", which employs a toroidal coil. For an electronic watthour meter to be immune to the effects of external magnetic fields that might result from currents flowing in conductors in the vicinity of the meter, it is necessary that the cross-section of the coil be constant, that is, exhibit the same cross-sectional area at any angular position, and that the turns be equally spaced. In addition, due to size limitations imposed by the meter base, the required coil is relatively long compared to the diameter. The disadvantage of such a coil is that it is costly to make by ordinary winding techniques used for mass production.

SUMMARY OF THE INVENTION

In accordance with this invention there is provided a method for making an electrical sensor coil, which method comprises the steps of applying an elongated electrical winding onto at least one side of an elongated flexible insulating substrate, which winding includes longitudinal and transverse portions which latter portions are generally equally spaced, folding the substrate repeatedly in opposite directions on transverse lines adjacent to the transverse portions to form substrate sections, and bending the folded substrate into a cylindrical toroidal core having adjacent substrate sections disposed at acute angles to each other forming a star-like cross-section.

The invention also comprises a sensor coil for an electronic watthour meter, which coil is mounted on each current conductor passing through the meter in which coil includes a winding on at least one side of a dielectric substrate, which substrate has a plurality of folds parallel to the axis of the current conductor which folds form substrate sections with adjacent sections disposed at acute angles to each other in a star-like pattern around the conductor, and the winding including spaced transverse portions adjacent to the folds with the windings being interconnected in series by longitudinal portions thereof. The invention also includes an embodiment in which windings are disposed on opposite sides of each substrate section, which windings are electrically connected so that transverse portions of the windings on opposite sides of each section have voltages induced which are serially in-phase with each other.

The advantage of the device and method of this invention is that there is provided greater output voltages from the coil and greater immunity to noise voltages due to external magnetic fields. The sensor coil of this invention also includes the advantage of inherent linearity and a potential for low manufacturing cost.

BRIEF DESCRIPTION OF THE DRAWINGS

FIG. 10 is a diagrammatic view showing the manner in which a coil winding having a cancelling turn is disposed with respect to magnetic field lines on an adjacent conductor;

FIG. 11 is a front view with parts removed of an AC electric meter having a mutual inductance current sensing transformer of the type disclosed in this invention; and FIG. 12 is an elevational view of the transformer molded on an electrical conductor.

DESCRIPTION OF THE PREFERRED EMBODIMENTS

Figure 1:
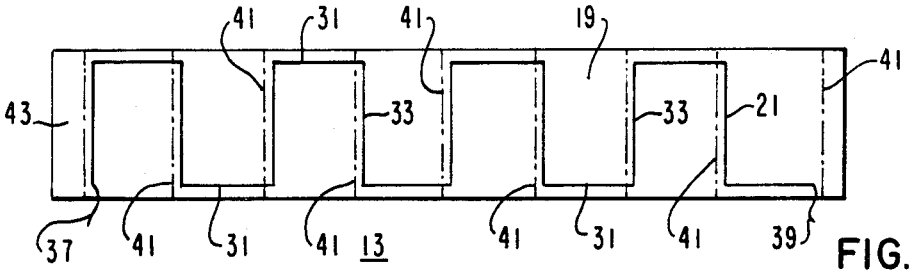
FIG. 1 is a plan view of a strip of a dielectric substrate having a coil winding mounted thereon.
Figure 4:
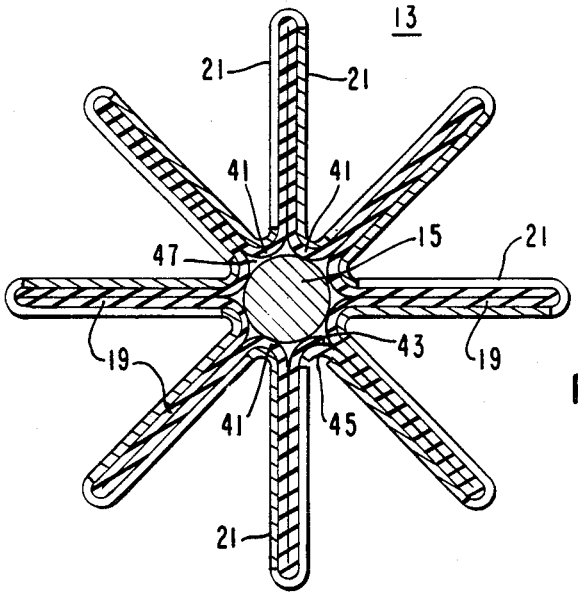
FIG. 4 is a sectional view taken on the line IV—IV of FIG. 12, showing the manner of its final assembly on an electric conductor.

In FIG. 4 a sensor coil is generally indicated at 13 where it is shown in its assembled form and mounted on an electric conductor 15. The coil 13 is comprised of a substrate 19 and a winding 21. In its initial stage of formation (FIG. 1) the substrate 19 is disposed in a flat condition to facilitate the application of the winding 21.

The substrate 19 is a sheet or film of insulating material, such as paper, fish paper, Nomex, cellulose acetate, Mylar, Kapton, varnished glass cloth, and the like.

The winding 21 of electrically conductive material may be a wire bent to the required shape and attached to the substrate by an adhesive. However, a preferred procedure is to coat the substrate with copper, apply a photo-resist, expose the resist to a suitably patterned source of radiation, such as ultraviolet, visible light, laser, X-ray, electron beam, the pattern of which is produced by a mask or by relative motion of a collimated beam of radiation, after which the photoresist is developed and the copper is etched. Such a procedure is commonly used for making printed circuits. The winding 21 may also be a conductive ink which is applied to the substrate by a patterned roller or by silk screen techniques.

Another procedure for applying the winding is to use a photosensitive film or coating, such as a photographic emulsion, which is converted to a conductive metal by the action of light, and if necessary, further chemical treatment.

In most cases a metal, such as copper, aluminum, siver, or gold, is used as the winding. Other materials, however, such as graphite, silicon, sulphur nitride, and polyacetylene, may be used.

Figure 5:
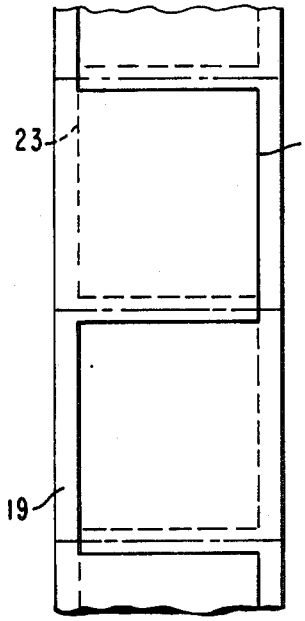
FIGS. 5, 6, and 7 are plan views of other embodiments showing different patterns of the coil winding, and showing the manner in which windings on opposite sides of a strip are disposed.
Figure 6:
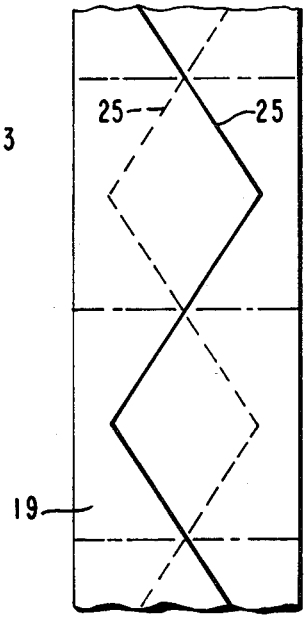
Figure 7:
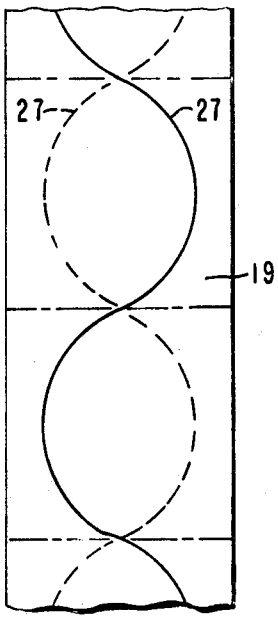

Various patterns of the winding may be used, such as those shown in FIGS. 5, 6, and 7, including a rectangular pattern 23, a zigzag pattern 25, and a sinuous pattern 27, respectively.

For the use of the winding in a watthour meter 29, (FIG. 11) the rectangular pattern of winding 21 (FIG. 1) is preferred and it includes longitudinal portions 31 and transverse portions 33. The rectangular structure including the transverse portions 33 extending almost completely across the width of the substrate 19, are most effective in confronting the field lines from the conductor 15 as well as external conductors 35 (FIG. 10). Lead wires 37, 39 extend from opposite ends of the winding 21.

Figure 2:
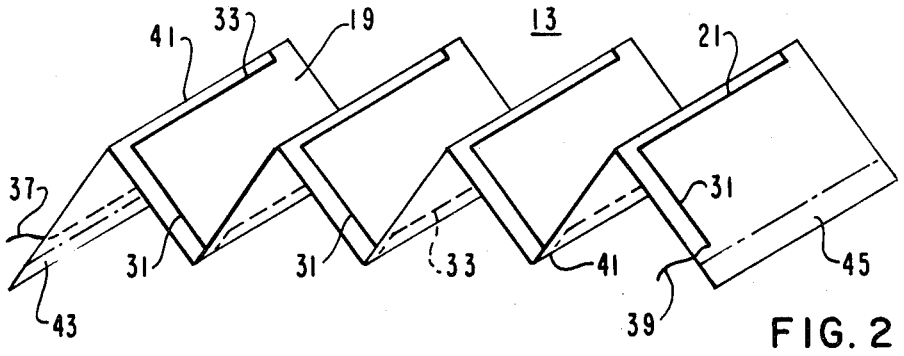
FIG. 2 is an isometric view showing the strip of FIG. 1 folded at prescribed fold lines.
Figure 3:
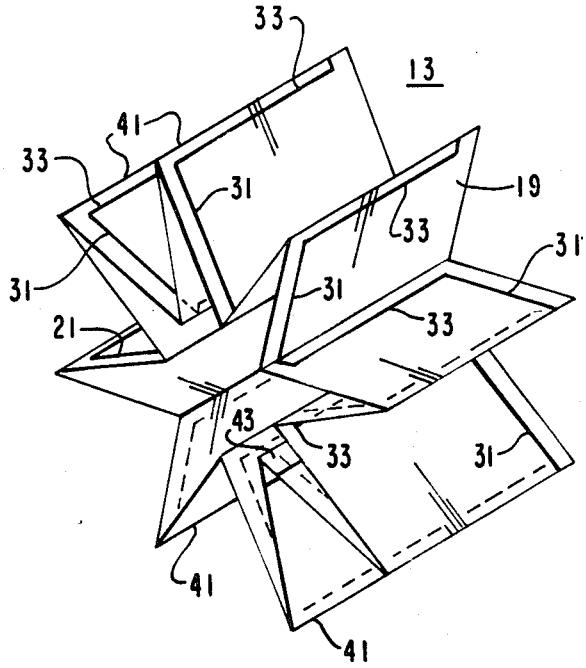
FIG. 3 is a perspective view of the folded strip of FIG. 2 bent into a toroidal coil before being mounted on an electric conductor.

After the winding 21 is attached or applied to the substrate 19 the substrate is folded along preferably equally spaced fold lines 41 to form the folded coil 13 (FIG. 2). If desirable, an insulating layer of film, such as varnish, may be applied over the winding 21 and the substrate 19 either before or after folding. The fold lines 41 are preferably provided at regular intervals and adjacent to the transverse portions 33. An alternative to applying the winding 21 to the substrate 19 before folding may include applying it after folding. The folded coil 13 is then bent into a cylindrical shape (FIG. 3) with the axis of the cylinder parallel to the transverse portions 33 of the winding. This is done with the winding 21 on the inside or the outside of the substrate 19. In the former case, successive turns of the winding come in contact with each other unless an insulating film is applied or the winding pattern is modified. For this reason, bending the coil with the winding on the outside is preferred (FIG. 3). For convenience of handling opposite end portions 43, 45 are secured together with a suitable ahesive.

Various sizes of a central hole 47 (FIG. 4) can be accommodated, depending on how the device is constrained. If it is compressed until the inner folds 41 touch each other, such as when mounted on the conductor 15, the inner turns of the coil are evenly spaced. In the resulting configuration of the adjacent fold sections are substantially radially extending from the axis of the conductor, whereby a star-shaped cross-section is provided. Under other circumstances, such as where the conductor 15 is of larger diameter, the central hole 47 is of larger diameter, whereby the adjacent folded sections of the coil are in a star-shaped configuration, such as shown in FIG. 3, that is the contacting surfaces of adjacent folded sections do not form an interface which extends radially outwardly from the conductor 15 as shown in FIG. 4.

Suffice it to say, for the purpose of this description the configurations of FIGS. 3 and 4 may be regarded as having a star-shaped cross-section. Other parameters dictating the size of the hole 47 include the number of folds, the thickness of the substrate, the thickness of the winding, and the sharpness of the folds. If the substrate and winding are both 1 mil thick, and a 300 turn coil is constructed, the central hole 47 has a diameter of about 0.5 inch. The outer holes of this configuration do not touch and thus automatically assume a precise uniform spacing. Where precise spacing is required in the outer portion of the turns, it is attained by applying transverse strips of tape, varnish, lacquer, adhesive-coated wedges of dielectric material, such as Micarta, wood, ceramic, or coated fabric, for the purpose of supporting the film before, during and after folding at the locations where they are outer folds. For example, where a 300 turn coil with 1 mil substrate and windings is provided, if an outer diameter of 2 inches is employed, cross strips of about 17 mil thickness gives the required spacing. Moreover, an electrically insulative sleeve 49 (FIG. 11) may be used to hold the coil in the compressive configuration.

Other methods may be used for attaining uniform spacing of the turns. Various types of jigs with pins, slots, or fins to align the folds can be used or wedges can be inserted between them. Adhesive coatings on the outside of the sleeve 49 or on the inside of an outer tube (not shown) may be used for support. Additional support, as well as electrical insulation, improved heat dissipation, and protection from moisture and air, may be provided by an impregnating resin. Suitable resins are epoxies, unsaturated polyesters, diallyl phthalate, and certain silicones.

As indicated above, various patterns may be used for the winding. The rectangular winding 23 with uniformly spaced turns and 90° corners is probably optimum for many purposes, but other patterns, such as the zigzag and sinuous patterns 25, 27 (FIGS. 6, 7) are also produced easily by standard photolithographic, silk screen, or other processes. For example, the winding 27 may be applied as a sine wave. The inner and outer portions of each turn may be of different lengths, the coil may taper from one end to the other, or the coil may be discontinuous, so that several individual coils are produced. The lead lines 37, 39 are attached to the ends of the winding by standard methods such as printed circuit technology. If necessary, additional lead lines can be attached at other locations. The foregoing sets forth a three-dimensional toroidal core comprising a single winding 21.

Figure 8:
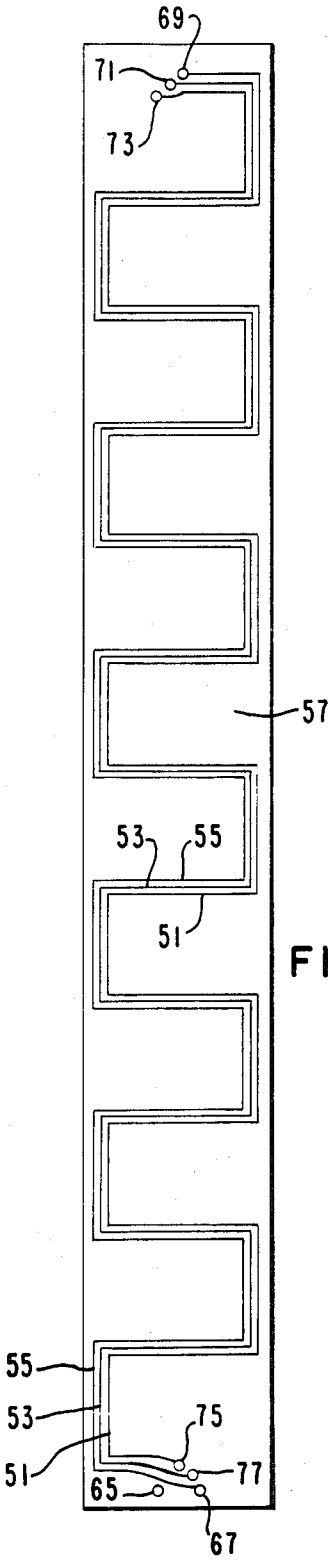
FIG. 8 is a plan view of one side of a dielectric strip on which a plurality of windings are disposed.
Figure 9:
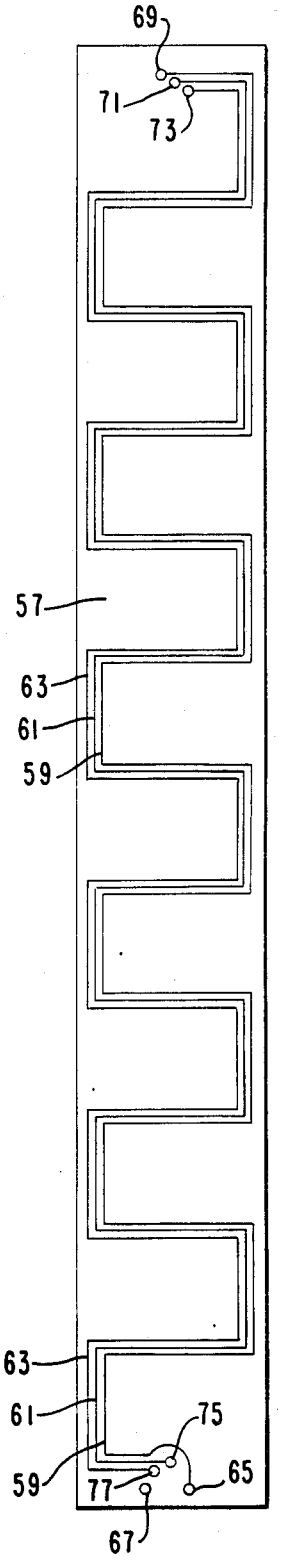
FIG. 9 is a plan view of the opposite side of the strip of FIG. 8 showing the manner in which a plurality of windings are disposed.

In accordance with this invention a sensor coil is also provided having two or more windings on a substrate by adding one or more windings to each side of the substrate. As shown in FIG. 8 three windings 51, 53, 55 are applied to a substrate 57 which windings have the rectangular or square wave pattern. Similarly, three additional windings 59, 61, 63 having a rectangular or square wave pattern are disposed on the opposite side of the substrate 57 and are geometrically 180° out of phase with the windings 51, 53, 55 as viewed from the front side. A pair of terminals 65, 67 are provided at the lower end of the substrate 57 as viewed in FIGS. 8 and 9. Each winding on one side is connected with a corresponding winding on the other side by means of eyelets 69, 71, 73. An example of a circuit through the several windings between start and finish terminals 65, 67, respectively, extends through the winding 59 to the eyelet 69, through the winding 51 to an eyelet 75, through the winding 61 and the eyelet 71 to the winding 53 to an eyelet 77, through the winding 63 and eyelet 73 to the winding 65 and the terminal 67. Accordingly, when the substrate 57 with windings is folded into a toroidal coil and mounted on a conductor similar to that shown in FIG. 4, the polarities of the transverse portions of the several windings 51, 53, 55, 59, 61, 63 are additive and serially produce a higher voltage than a single winding.

Another advantage of the double winding is that the incidental single turn made by the winding on one side as it is distributed circumferentially is cancelled by the winding on the other side with which it is connected in series. Thus, as shown in FIG. 10 by way of example, the folded windings 55, 59 around the conductor 15 have a cancelling effect upon external magnetic field lines 79 generated by a nearby conductor 35. However, the main advantage of the double winding is the greater output voltage afforded.

One preferred form in which the sensor coil 13 is employed is shown in FIGS. 11, 12 in which an electronic watthour meter 81 is mounted on a watthour mounting base 83. Line side hot wire conductors of three wire 240/120 volts service lines, connect the voltage and current transmitted from an AC source such as provided by a pole top distribution transformer, to blade terminals 85, 87, 89, 91. A pair of straight heavy primary conductors 15, 17 extend between corresponding pairs of the blades.

The meter 81 comprises a pair of cylindrical transducer units 93, 95. The conductor 15 extends through a bore or window of the unit 93 from which it is insulated by electrically insulative sleeve 49. Similarly, the conductor 17 extends through a bore or window of the unit 91 from which it is insulated by insulative sleeve 49. The transducer units 93, 95 embody the structure of the sensor coil 13 having the toroidal windings as set forth above. The lead wires 37, 39 extend from the units 13 and to a suitable electronic processing circuit. Additional shielding, such as shown in U.S. Pat. No. 4,413,230, may be employed as required.

Accordingly, the sensor coils are basically an air-core current transformer which is similar to a conventional iron core current transformer except that there is no iron core because the winding is placed upon a non-magnetic coil form of some sort rather than on an iron core. The elimination of the iron core opens new manufacturing possibilities which are more compatible with high volume and automated processes. The sensor coil described herein provides greater immunity to noise voltages due to external magnetic fields and therefore better linearity. Moreover, the sensor coil is perfectly linear in the transduction of current to voltage due to the constant permeability of air at all induction levels as opposed to iron-cores where this is not the case. Finally, the air-core current transformer produces an output voltage proportional to rate-of-change of current (di/dt), while the current transformer produces a secondary current which is scaled to the sense current by a constant i/k. The signals from the two devices are processed differently.

What is claimed is:

1. A method of making an electrical sensor coil without winding, comprising the steps of:

(a) providing an elongated flexible insulating substrate having opposite sides, opposite edges, and opposite ends;

(b) applying an elongated electrical conductor onto at least one side of the substrate and extending substantially from one end to the other end with the conductor having longitudinal and transverse portions which latter portions are at generally equally spaced intervals;

(c) folding the substrate along each of a plurality of the transverse lines to form substrate sections; and (d) bending the folded substrate into a cylindrical toroidal core having adjacent substrate sections disposed at acute angles to each other forming a star-like cross-section.

2. The method of claim 1 in which the conductor has a sinuous pattern from one end to the other.

3. The method of claim 1 in which the conductor has a rectangular pattern including spaced transverse and longitudinal portions, the longitudinal portions extending along and near the alternate opposite edges of adjacent sections and between corresponding ends of adjacent transverse portions.

4. The method of claim 1 in which the transverse portions are equally spaced.

5. The method of claim 4 in which the folds occur adjacent to the transverse portions to form a plurality of adjacent substrate sections.

6. The method of claim 5 in which alternate folds are disposed in an outer peripheral zone of the star-like configuration, and the other folds are disposed in an inner circular zone thereof.

7. In an electronic watthour meter of the type wherein current conductors extend through the meter between corresponding power line side wire conductors and load side wire conductors, electronic circuitry means measuring circuit processing signals responsive to current and voltage components of an alternating current supplied by the current conductors, the combination with the circuitry of a sensor coil on each current conductor and including a winding on at least one side of a dielectric substrate, the substrate having a plurality of folds parallel to the axis of the current conductor which folds form substrate sections with adjacent sections disposed at acute angles to each other in a star-like pattern around the conductor, and the winding including spaced transverse portions adjacent to the folds and which portions are interconnected in series by longitudinal portions.

8. The sensor coil of claim 7 in which a winding is disposed on each side of the substrate.

9. The sensor coil of claim 8 in which the windings on opposite sides of the substrate are connected in series so as to provide cancelling polarity turns.

10. The sensor coil of claim 9 in which a first winding is applied on one side of the substrate and a second winding on the other side of the substrate.

11. The sensor coil of claim 10 in which one pair of corresponding ends of the first and second windings are electrically connected and are geometrically 180° out of phase with each other.

12. The sensor coil of claim 11 in which the polarities of the transverse portions of windings on opposite sides of each substrate section are additive and serially produce a higher voltage than a single winding.

* * * * *